US012584478B2

(12) United States Patent
Poehls et al.

(10) Patent No.: US 12,584,478 B2
(45) Date of Patent: Mar. 24, 2026

(54) PACKING RETAINING COMPONENT FOR A FLUID PUMP

(71) Applicant: SPM Oil & Gas Inc., Fort Worth, TX (US)

(72) Inventors: Justin Poehls, Glen Rose, TX (US); David T. Figgs, Fort Worth, TX (US); Abraham Canales, Crowley, TX (US); Nuder Said, Fort Worth, TX (US); Chiawei Steven Su, Arlington, TX (US); Daryl Belshan, Weatherford, TX (US); Alireza Atabaie, Keller, TX (US)

(73) Assignee: SPM Oil & Gas Inc., Fort Worth, TX (US)

( * ) Notice: Subject to any disclaimer, the term of this patent is extended or adjusted under 35 U.S.C. 154(b) by 0 days.

(21) Appl. No.: 18/787,123

(22) Filed: Jul. 29, 2024

(65) Prior Publication Data

US 2026/0028981 A1 Jan. 29, 2026

(51) Int. Cl.
*F04B 53/10* (2006.01)
*F04B 53/02* (2006.01)
*F04B 53/22* (2006.01)

(52) U.S. Cl.
CPC ..... *F04B 53/10* (2013.01); *F04B 53/02* (2013.01); *F04B 53/22* (2013.01)

(58) Field of Classification Search
CPC ..... F04B 53/10; F04B 53/02; F04B 53/22; Y10T 137/7559; Y10T 137/6011; F16K 2200/50; F16K 2200/501; F16K 2200/502
USPC ..... 137/454.2, 315.11
See application file for complete search history.

(56) References Cited

U.S. PATENT DOCUMENTS 4,432,386 A * 2/1984 Pacht ..... F04B 49/10 137/540
4,551,077 A * 11/1985 Pacht ..... F04B 53/109 417/454
4,878,815 A * 11/1989 Stachowiak ..... F04B 53/1025 417/454
5,127,807 A * 7/1992 Eslinger ..... F04B 53/147 417/539
5,174,327 A * 12/1992 Truax ..... F16K 15/026 137/515.3

(Continued)

FOREIGN PATENT DOCUMENTS

CN 203394736 U 1/2014
CN 103410721 B 10/2015
WO 2020198535 A1 10/2020

*Primary Examiner* — Mark A Laurenzi
*Assistant Examiner* — Benjamin Doyle

(57) ABSTRACT

A fluid end of a fluid pump may include a fluid end block with a bore in which a plunger is to reciprocate. The fluid end may include a valve cartridge, configured for insertion into and removal from the bore as a unit, including a valve cartridge housing having an open end, and a plurality of valves operably connected to the valve cartridge housing. The fluid end may include a packing cartridge, configured for insertion into and removal from the bore as a unit, including a packing cartridge housing having a plunger bore, to receive the plunger, that defines a first open end and a second open end of the packing cartridge housing. The valve cartridge housing and the packing cartridge housing are engaged such that the open end of the valve cartridge housing and the first open end of the packing cartridge housing overlap.

19 Claims, 5 Drawing Sheets

(56) References Cited

U.S. PATENT DOCUMENTS

| | | | | |
|---|---|---|---|---|
| 5,924,853 | A * | 7/1999 | Pacht | F04B 53/147 417/567 |
| 6,231,323 | B1 * | 5/2001 | Jezek | F04B 53/164 137/493.9 |
| 7,121,812 | B2 * | 10/2006 | Forrest | F04B 53/22 417/571 |
| 8,147,226 | B2 * | 4/2012 | Koka | F04B 9/02 417/571 |
| 10,941,765 | B2 | 3/2021 | Nowell et al. | |
| 10,975,905 | B1 | 4/2021 | Freed et al. | |
| 11,231,064 | B2 | 1/2022 | Chunn | |
| 11,674,509 | B2 | 6/2023 | Belshan et al. | |
| 11,946,465 | B2 * | 4/2024 | Barnett | F04B 19/22 |
| 11,959,476 | B2 | 4/2024 | Figgs et al. | |
| 12,012,954 | B2 * | 6/2024 | Thomas | F04B 53/006 |
| 2005/0249615 | A1 * | 11/2005 | Jezek | F04B 53/168 417/415 |
| 2015/0071803 | A1 * | 3/2015 | Huang | F04B 39/1046 417/560 |
| 2015/0101694 | A1 * | 4/2015 | Forrest | F04B 53/164 137/861 |
| 2022/0282717 | A1 * | 9/2022 | Thomas | F04B 53/16 |
| 2023/0081099 | A1 | 3/2023 | Davids | |
| 2023/0366395 | A1 * | 11/2023 | Schaer, III | F04B 53/108 |
| 2024/0068469 | A1 * | 2/2024 | Barnett | F16K 25/005 |
| 2024/0110562 | A1 | 4/2024 | Kay | |
| 2024/0125222 | A1 | 4/2024 | Foster et al. | |

* cited by examiner

PACKING RETAINING COMPONENT FOR A FLUID PUMP

TECHNICAL FIELD

The present disclosure relates generally to fluid pumps and, for example, to a packing retaining component for a fluid pump.

BACKGROUND

Hydraulic fracturing is a well stimulation technique that typically involves pumping hydraulic fracturing fluid into a wellbore at a rate and a pressure (e.g., up to 15,000 pounds per square inch (psi)) sufficient to form fractures in a rock formation surrounding the wellbore. This well stimulation technique often enhances the natural fracturing of a rock formation to increase the permeability of the rock formation, thereby improving recovery of water, oil, natural gas, and/or other fluids.

Positive displacement pumps are commonly used for high pressure hydrocarbon recovery applications, such as injecting hydraulic fracturing fluid down the wellbore. A positive displacement pump typically has two sections, a power end and a fluid end, connected by stay rods. The power end includes a crankshaft powered by an engine or another power source that drives plungers of the fluid end. A packing may be disposed in the fluid end to prevent leakage of fluid from around a plunger during pumping operations. The packing may be replaced at times to maintain a good seal around the plunger. However, replacement of the packing through a back end of the fluid end may be difficult due to obstruction from the stay rods. Moreover, over time, the fluid end may experience wear due to high applied pressures and reciprocation of the plungers, which can lead to leaks and/or failure of the fluid end.

The packing retaining component of the present disclosure solves one or more of the problems set forth above and/or other problems in the art.

SUMMARY

A fluid end of a fluid pump may include a fluid end block with a bore in which a plunger is to reciprocate. The fluid end may include a valve cartridge, configured for insertion into and removal from the bore as a unit, including a valve cartridge housing having an open end, and a plurality of valves operably connected to the valve cartridge housing. The fluid end may include a packing cartridge, configured for insertion into and removal from the bore as a unit, including a packing cartridge housing having a plunger bore, to receive the plunger, that defines a first open end and a second open end of the packing cartridge housing, wherein the valve cartridge housing and the packing cartridge housing are engaged such that the open end of the valve cartridge housing and the first open end of the packing cartridge housing overlap.

A packing cartridge may include a packing cartridge housing having a plunger bore defining a first open end and a second open end of the packing cartridge housing. The packing cartridge housing may include an inner circumferential notch between the first open end and the second open end, and a neck that includes the first open end, where the neck is configured to overlap with a valve cartridge housing.

A fluid pump may include a power end, and a fluid end coupled to the power end. The fluid end may include a fluid end block with a bore, and a plunger configured to reciprocate with respect to the bore. The fluid end may include a valve cartridge, configured for insertion into and removal from the bore as a unit. The valve cartridge may include a valve cartridge housing having an open end, and a plurality of valves operably connected to the valve cartridge housing. The fluid end may include a packing retaining component with a plunger bore, to receive the plunger, that defines a first open end and a second open end of the packing retaining component. The valve cartridge housing and the packing retaining component may be engaged such that the open end of the valve cartridge housing and the first open end of the packing retaining component overlap.

DETAILED DESCRIPTION

This disclosure relates to a packing retaining component, which is applicable to any reciprocating pump. For example, the reciprocating pump may be a hydraulic fracturing pump used in a hydraulic fracturing application.

Figure 1:
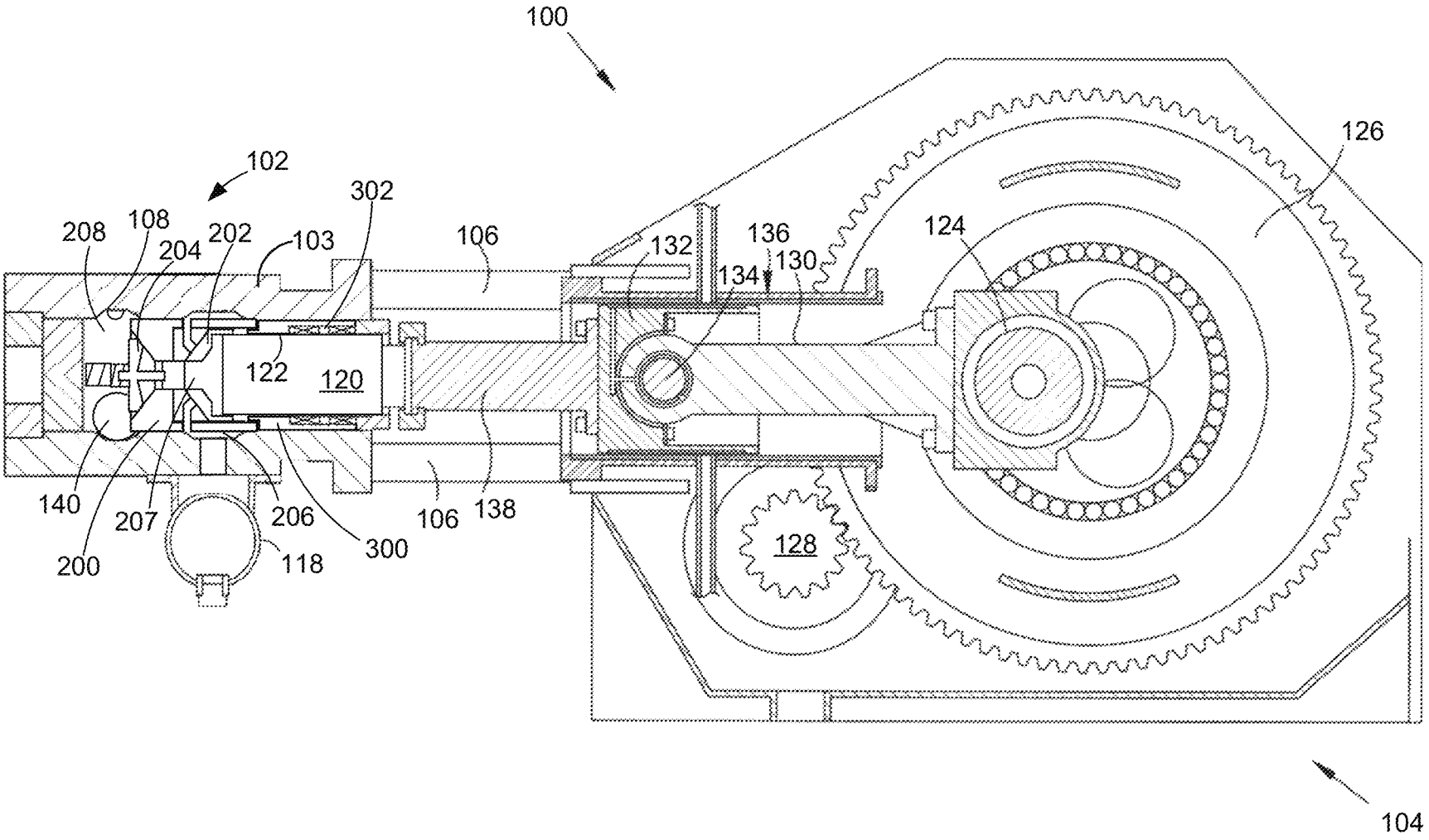
FIG. 1 is a cross-sectional view of an example fluid pump.

FIG. 1 is a cross-sectional view of an example fluid pump 100. The fluid pump 100 includes a fluid end 102 and a power end 104. The fluid end 102 may be connected to the power end 104 by stay rods 106. The fluid end 102 includes a fluid end block 103 having one or more bores 108 (only one shown). For example, the fluid pump 100 may include one, two, three, four, five, or more bores 108. In some implementations, the fluid pump 100 may be mounted on a trailer to facilitate transportation of the fluid pump 100 between operational sites. In some implementations, the fluid pump 100 may be a hydraulic fracturing pump. For example, the fluid pump 100 may have a capability to produce a discharge pressure of at least 8,000 psi, at least 10,000 psi, at least 12,000 psi, or at least 15,000 psi.

The bore 108 is a passageway through the fluid end block 103 of the fluid end 102. The fluid end 102 may include a valve cartridge 200 disposed in the bore 108 (e.g., a respective valve cartridge 200 may be disposed in each bore 108 of the fluid end 102). For example, the valve cartridge 200 is configured for insertion into, and removal from, the bore 108 as a unit. The valve cartridge 200 includes a suction valve 202 and a discharge valve 204. The suction valve 202 and the discharge valve 204 may have different configurations from that depicted in FIG. 1. The bore 108 may be contoured such that when the valve cartridge 200 is disposed in the bore 108, the valve cartridge 200 partitions the bore 108 into a suction chamber 206, a pressure chamber 207, and a discharge chamber 208 of the bore 108. For example, the suction chamber 206 of the bore 108 may be fluidly connected to a suction manifold 118, and the discharge chamber 208 of the bore 108 may be fluidly connected to a discharge manifold 140.

In operation, fluid is pressurized to a low pressure (e.g., 80 psi) by an outside system (e.g., a centrifugal pump) and pushed through the suction manifold 118 through the suction valve 202 and into the pressure chamber 207. The fluid is then pumped in response to a forward stroke of a plunger 120 and flows through the discharge valve 204.

In operation, the plunger 120 moves in a plunger bore 122 and is driven by the power end 104 of the fluid pump 100. The power end 104 includes a crankshaft 124 that is rotated by a gearbox output 126, which is illustrated by a single gear but may be more than one gear. A gearbox input 128 is coupled to a transmission (not shown) and/or a prime mover (not shown), such as a diesel engine, to rotate the gearbox input 128 during operation. A connecting rod 130 mechanically connects the crankshaft 124 to a crosshead 132 via a wrist pin 134. The crosshead 132 is mounted within a stationary crosshead housing 136, which constrains the crosshead 132 to linear reciprocating movement. A pony rod 138 connects to the crosshead 132 and has its opposite end connected to the plunger 120 to enable reciprocating movement of the plunger 120.

In operation, movement of the crankshaft 124 causes the plunger 120 to reciprocate with respect to the bore 108 (e.g., to reciprocate toward and away from the bore 108). As the plunger 120 translates away from the bore 108 (a suction stroke of the plunger 120), the pressure of the fluid inside the pressure chamber 207 decreases, which creates a pressure differential across the suction valve 202. The pressure differential across the suction valve 202 enables actuation of the suction valve 202 to allow the fluid to enter the pressure chamber 207 from the suction manifold 118 (e.g., the suction valve 202 may open responsive to the pressure differential). The pumped fluid is pushed into the pressure chamber 207 as the plunger 120 continues to translate away from the bore 108. As the plunger 120 changes directions and moves toward the bore 108 (a discharge stroke of the plunger 120), the fluid pressure inside the pressure chamber 207 increases, which creates a pressure differential across the discharge valve 204. Fluid pressure inside the pressure chamber 207 continues to increase as the plunger 120 approaches the bore 108 until the pressure differential across the discharge valve 204 is great enough to actuate the discharge valve 204 and enable the fluid to exit the pressure chamber 207 (e.g., the valve may open responsive to the pressure differential).

The fluid end 102 may include a packing cartridge 300 disposed in the bore 108 (e.g., a respective packing cartridge 300 may be disposed in each bore 108 of the fluid end 102). For example, the packing cartridge 300 is configured for insertion into, and removal from, the bore 108 as a unit. The packing cartridge 300 is configured to retain a packing 302 (e.g., a packing set, a packing assembly, or the like) in the bore 108 around the plunger 120. In some implementations, the packing 302 may be held in a packing sleeve. The packing 302 may include one or more rings (e.g., composed of polymer, metal, or another material) that circumferentially surround the plunger 120 and that are configured to prevent leakage of fluid from around the plunger 120.

As indicated above, FIG. 1 is provided as an example. Other examples may differ from what is described with regard to FIG. 1.

Figure 2:
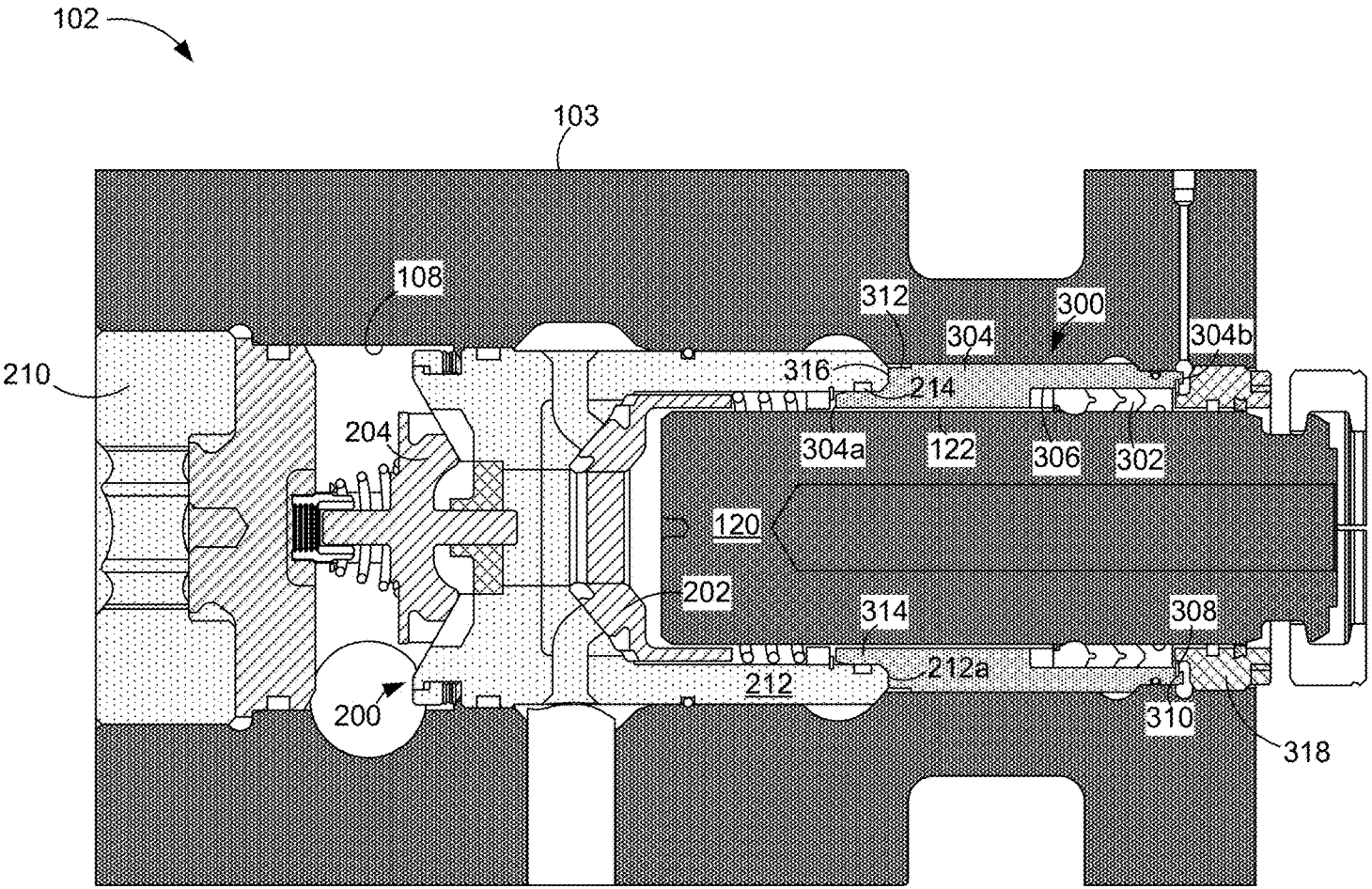
FIG. 2 is a cross-sectional view of an example of a fluid end of a fluid pump.

FIG. 2 is a cross-sectional view of an example of the fluid end 102 of the fluid pump 100. The example fluid end 102 of FIG. 2 may include the valve cartridge 200 and the packing cartridge 300 that are removably disposed in the bore 108. The valve cartridge 200 and the packing cartridge 300 may be arranged in the bore 108 co-axially with the plunger 120. The fluid end block 103 has a front end and a back end, opposite the front end. The plunger 120 may extend into the bore 108 from the back end of the fluid end block 103 (e.g., the stay rods 106 connect at the back end of the fluid end block 103). The fluid end block 103 is configured to allow the valve cartridge 200 and the packing cartridge 300 to be removed from, and inserted into, the bore 108 from the front end.

In some examples, the fluid end 102 may include an end cap assembly 210 disposed in the bore 108. The end cap assembly 210 may seal an end of the bore 108 (e.g., the end cap assembly 210 may seal front-end access to the bore 108). The end cap assembly 210 may be removed from the bore 108 to provide access to the valve cartridge 200 and/or the packing cartridge 300 from the front-end of the fluid end block 103. Thus, with the end cap assembly 210 removed from the bore 108, the valve cartridge 200 and/or the packing cartridge 300 may be removed from the fluid end 102, as a unit, to facilitate repair or replacement. Similarly, a replacement, or a repaired, valve cartridge 200 and/or packing cartridge 300 may be inserted into the bore 108 and the end cap assembly 210 may be replaced back into the bore 108 to reseal the bore 108.

The valve cartridge 200 includes a valve cartridge housing 212, which may have an overall cylindrical shape. A plurality of valves, such as the suction valve 202 and the discharge valve 204, are operably connected to the valve cartridge housing 212 (e.g., connected in a manner that allows the suction valve 202 and the discharge valve 204 to open and close in response to pressure differentials). The valve cartridge housing 212 may have an open end **212*a*, which may be configured to receive the plunger 120 (e.g., at least a portion of the plunger 120). For example, during a discharge stroke of the plunger 120, the plunger 120 may extend through the open end 212*a* into the valve cartridge housing 212**, as shown.

The packing cartridge 300 is a packing retaining component. The packing cartridge 300 includes a packing cartridge housing 304, which may have an overall cylindrical shape. The packing cartridge housing 304 may define the plunger bore 122 that receives the plunger 120. The plunger bore 122 may define a first open end **304*a* and a second open end 304*b* of the packing cartridge housing 304 (e.g., defining a sleeve). The packing cartridge housing 304 may have an inner circumferential notch 306 between the first open end 304*a* and the second open end 304*b*, and the packing 302 may be disposed in the notch 306. As shown, the notch 306 may be nearer to the second open end 304*b* than to the first open end 304*a* of the packing cartridge housing 304. The packing cartridge 300 may include a retainer clip 308 configured to retain the packing 302 in the notch 306. The retainer clip 308 may be disposed in an inner circumferential groove 310 in the packing cartridge housing 304. The groove 310, and the retainer clip 308 therein, may be between the notch 306 and the second open end 304*b* of the packing cartridge housing 304**.

Figure 3:
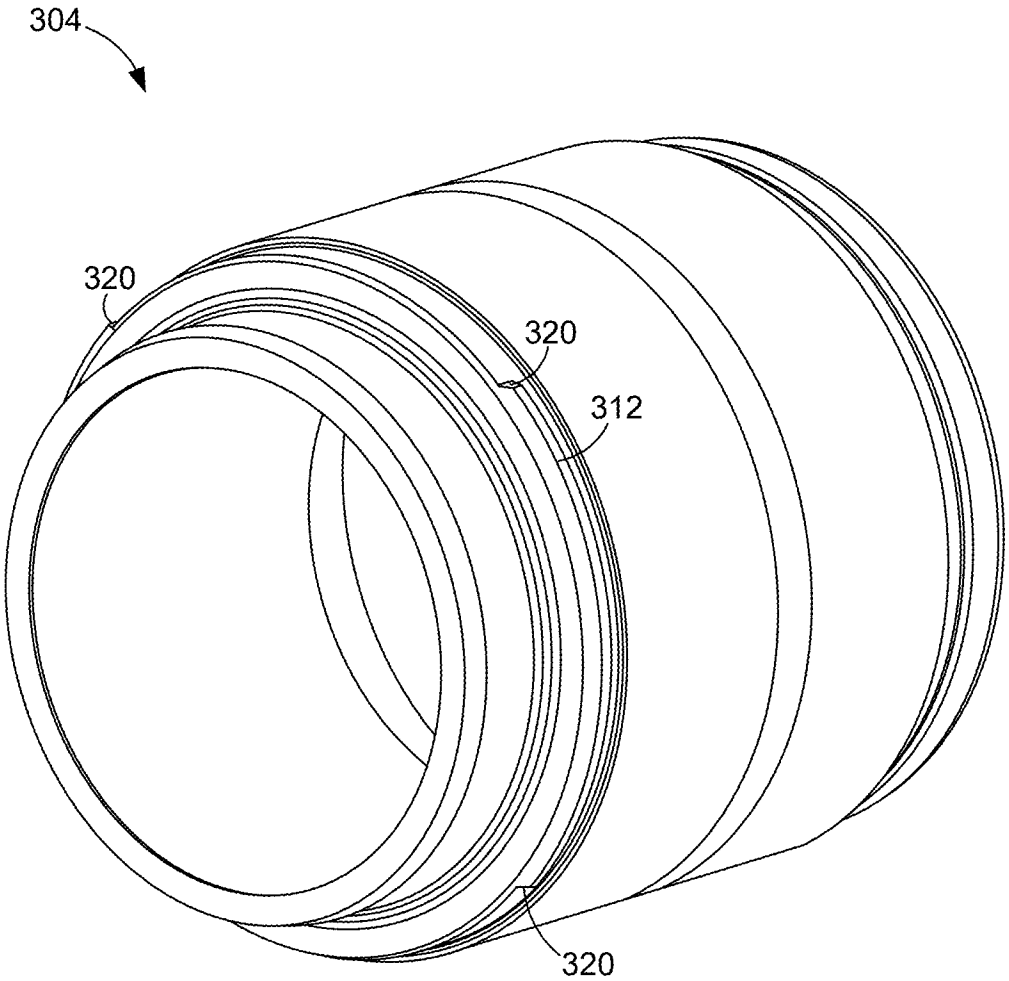
FIG. 3 is a perspective view of an example of a packing cartridge housing.

The packing cartridge housing 304 may include a tool engagement element 312 (described further in connection with FIG. 3). The tool engagement element 312 is configured to engage with (e.g., securely connect to) a tool that is configured to insert and remove the packing cartridge 300 from the bore 108. During insertion or removal of the packing cartridge 300, the retainer clip 308 ensures that the packing 302 remains positioned in the notch 306 of the packing cartridge housing 304.

The valve cartridge housing 212 and the packing cartridge housing 304 are engaged, such that the open end **212*a* of the valve cartridge housing 212 and the first open end 304*a* of the packing cartridge housing 304 overlap. For example, the packing cartridge housing 304 may have a neck 314 that includes the first open end 304*a* (e.g., the first open end 304*a* is also an end of the neck 314). The neck 314 may be a section of the packing cartridge housing 304 that has a lesser diameter relative to a remainder of the packing cartridge housing 304. The neck 314 and the remainder of the packing cartridge housing 304 may be an integral unit. The neck 314 of the packing cartridge housing 304 may be inserted into the valve cartridge housing 212 (e.g., until the open end 212***a* of the valve cartridge housing 212 abuts a shoulder 316 of the packing cartridge housing 304, or the open end 212*a* of the valve cartridge housing 212 and the shoulder 316 of the packing cartridge housing 304 may be separated by a gap), thereby producing the overlap between the open end 212*a* of the valve cartridge housing 212 and the first open end 304*a* of the packing cartridge housing 304.

An interface between the valve cartridge housing 212 and the packing cartridge housing 304 may be fluid tight (e.g., fluid flow through the interface may be prevented or substantially prevented). For example, the interface between the valve cartridge housing 212 and the packing cartridge housing 304 may isolate a portion of the fluid end block 103, along the plunger bore 122, from cyclic pressure in the fluid end 102 (e.g., due to reciprocation of the plunger 120), thereby reducing wear to the fluid end block 103. The "interface" between the valve cartridge housing 212 and the packing cartridge housing 304 may refer to an area where the valve cartridge housing 212 and the packing cartridge housing 304 are directly engaged, either by surface-to-surface contact or by a sealing ring 214. For example, the sealing ring 214 may be disposed in an inner surface of the valve cartridge housing 212, as shown. Alternatively, the sealing ring 214 may be disposed in an outer surface of the packing cartridge housing 304 (e.g., an outer surface of the neck 314).

As shown, the fluid end 102 may also include a packing nut 318 disposed in the bore 108. The packing nut 318 may surround the plunger 120, and may enclose an end of the bore 108 (e.g., the packing nut 318 may seal back-end access to the bore 108). The packing nut 318 may help to maintain the packing 302 in a proper position or compression. For example, the retainer clip 308 may be configured so as not to interfere with contact between the packing nut 318 and the packing 302.

As indicated above, FIG. 2 is provided as an example. Other examples may differ from what is described with regard to FIG. 2.

FIG. 3 is a perspective view of an example of the packing cartridge housing 304. As shown, the tool engagement element 312 may include a plurality of circumferential notches 320 that match with a socket of the tool. In some implementations, the tool engagement element 312 may include threads, a bayonet lock member, or another element that facilitates secure connection between the packing cartridge housing 304 and the tool.

As indicated above, FIG. 3 is provided as an example. Other examples may differ from what is described with regard to FIG. 3.

Figure 4:
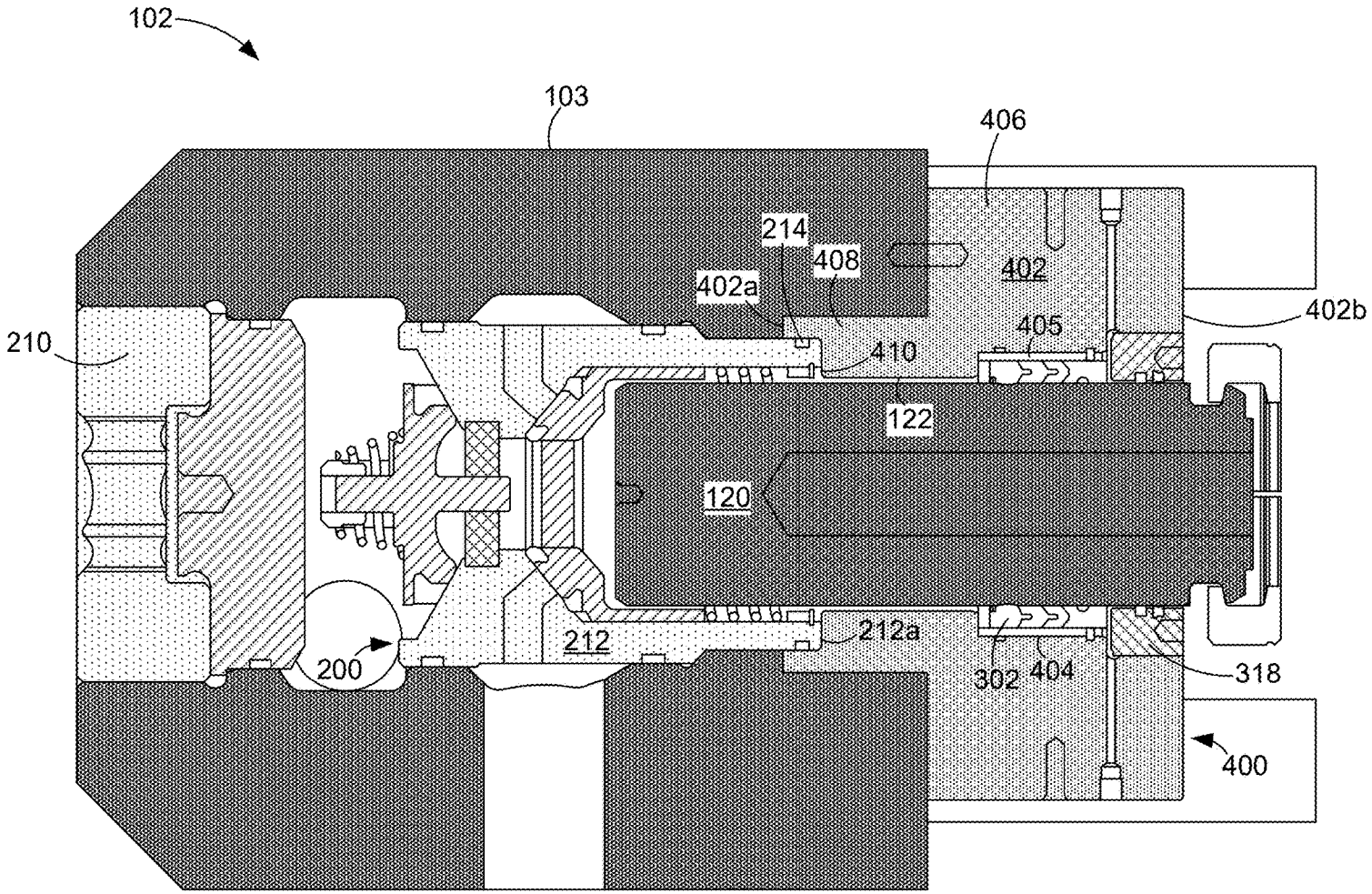
FIG. 4 is a cross-sectional view of an alternative example of a fluid end of a fluid pump.

FIG. 4 is a cross-sectional view of an alternative example of the fluid end 102 of the fluid pump 100. The example fluid end 102 of FIG. 4 may include the valve cartridge 200 and the end cap assembly 210, in a similar manner as described in connection with FIG. 2. However, the fluid end 102 of FIG. 4 may not include the packing cartridge 300.

Rather, the fluid end 102 may include a packing gland 400. The packing gland 400 is a packing retaining component. The packing gland 400 may be attached to the fluid end block 103 by a plurality of fasteners (not shown). Thus, the packing gland 400 may be referred to as a "removable packing gland" or a "bolt-on packing gland."

The packing gland 400 includes a packing gland housing 402. The packing gland housing 402 may define the plunger bore 122 that receives the plunger 120. The plunger bore 122 may define a first open end 402*a* and a second open end 402*b* of the packing gland housing 402. The packing gland housing 402 may have an inner circumferential notch 404 between the first open end 402*a* and the second open end 402*b*, and the packing 302 may be disposed in the notch 404 (e.g., in a packing sleeve 405, which can be replaced once worn).

The valve cartridge housing 212 and the packing gland housing 402 are engaged, such that the open end 212*a* of the valve cartridge housing 212 and the first open end 402*a* of the packing gland housing 402 overlap. For example, the packing gland housing 402 may have a flange 406 and a neck 408 extending from the flange 406. The neck 408 may have a lesser diameter than a diameter of the flange 406. The flange 406 and the neck 408 may be an integral unit. The neck 408 includes the first open end 402*a* of the packing gland housing 402 (e.g., the first open end 402*a* is also an end of the neck 408).

At the first open end 402*a*, the neck 408 may have a counterbore, such that a major bore diameter is greater than a diameter of the open end 212*a* of the valve cartridge housing 212. The counterbore may define a step 410 in an inner surface of the neck 408. The valve cartridge housing 212 may be inserted into the neck 408 of the packing gland housing 402 (e.g., until the open end 212*a* of the valve cartridge housing 212 abuts the step 410 in the neck 408, or the open end 212*a* of the valve cartridge housing 212 and the step 410 in the neck 408 may be separated by a gap), thereby producing the overlap between the open end 212*a* of the valve cartridge housing 212 and the first open end 402*a* of the packing gland housing 402.

In a similar manner as described in connection with FIG. 2, an interface between the valve cartridge housing 212 and the packing gland housing 402 may be fluid tight, and may isolate a portion of the fluid end block 103, along the plunger bore 122, from cyclic pressure in the fluid end 102. The "interface" between the valve cartridge housing 212 and the packing gland housing 402 may refer to an area where the valve cartridge housing 212 and the packing gland housing 402 are directly engaged, either by surface-to-surface contact or by the sealing ring 214. For example, the sealing ring 214 may be disposed in an outer surface of the valve cartridge housing 212, as shown. Alternatively, the sealing ring 214 may be disposed in an inner surface of the packing gland housing 402 (e.g., an inner surface of the neck 408).

As shown, the fluid end 102 may also include the packing nut 318 disposed in the plunger bore 122 of the packing gland housing 402. The packing nut 318 may surround the plunger 120, and may enclose an end of the plunger bore 122. The packing nut 318 may help to maintain the packing 302 in a proper position, and may help to press the packing gland housing 402 against the valve cartridge housing 212, in a similar manner as described in connection with FIG. 2.

As indicated above, FIG. 4 is provided as an example. Other examples may differ from what is described with regard to FIG. 4.

Figure 5:
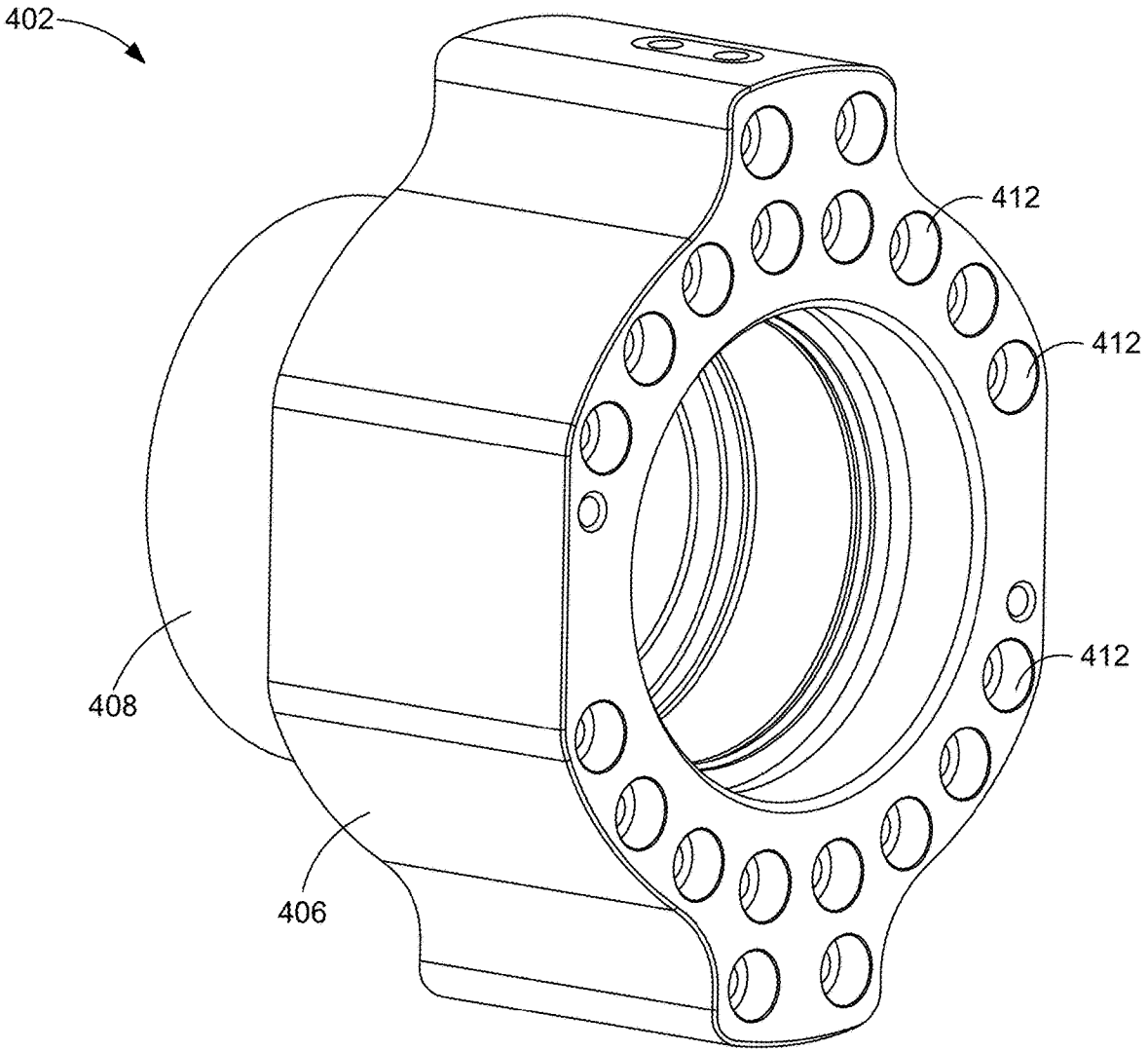
FIG. 5 is a perspective view of an example of a packing gland housing.

FIG. 5 is a perspective view of an example of the packing gland housing 402. As shown, a plurality of apertures 412 may be defined in the flange 406 of the packing gland housing 402. The apertures 412 may receive fasteners (e.g., bolts) that attach the packing gland housing 402 to the fluid end block 103.

As indicated above, FIG. 5 is provided as an example. Other examples may differ from what is described with regard to FIG. 5.

INDUSTRIAL APPLICABILITY

The packing retaining component (e.g., the packing cartridge 300 and/or the packing gland 400) described herein may be used with any fluid pump that uses a plunger to pressurize fluid. For example, the packing retaining component may be used with a positive displacement pump, such as a reciprocating pump. In particular, the packing retaining component may be employed in a fluid pump used in an application relating to oil and gas extraction, such as hydraulic fracturing. Over time, a fluid end of a fluid pump may experience wear due to high applied pressures and reciprocation of the plungers, which can lead to leaks and/or failure of the fluid end.

The packing retaining component described herein may be used in a bore of a fluid end block along with a valve cartridge. The packing retaining component may form a fluid-tight interface with the valve cartridge. This fluid-tight interface can isolate a portion of the fluid end block from cyclic pressure in the fluid end (e.g., due to reciprocation of the plunger). In this way, wear to the fluid end block is reduced, thereby increasing a useful life of the fluid end block. In some implementations, the packing retaining component is the packing cartridge 300, described herein. The packing cartridge 300 is configured for insertion and removal into the bore via the front end of the fluid end block, where there are less obstructions relative to the back end of the fluid end block. This facilitates easier insertion and removal of the packing cartridge 300 into the fluid end block, allowing for efficient repair or replacement of worn packing.

The foregoing disclosure provides illustration and description, but is not intended to be exhaustive or to limit the implementations to the precise forms disclosed. Modifications and variations may be made in light of the above disclosure or may be acquired from practice of the implementations. Furthermore, any of the implementations described herein may be combined unless the foregoing disclosure expressly provides a reason that one or more implementations cannot be combined. Even though particular combinations of features are recited in the claims and/or disclosed in the specification, these combinations are not intended to limit the disclosure of various implementations. Although each dependent claim listed below may directly depend on only one claim, the disclosure of various implementations includes each dependent claim in combination with every other claim in the claim set.

As used herein, "a," "an," and a "set" are intended to include one or more items, and may be used interchangeably with "one or more." Further, as used herein, the article "the" is intended to include one or more items referenced in connection with the article "the" and may be used interchangeably with "the one or more." Further, the phrase "based on" is intended to mean "based, at least in part, on" unless explicitly stated otherwise. Also, as used herein, the term "or" is intended to be inclusive when used in a series and may be used interchangeably with "and/or," unless explicitly stated otherwise (e.g., if used in combination with "either" or "only one of").

What is claimed is:

1. A fluid end of a fluid pump, comprising:

a fluid end block with a bore in which a plunger is to reciprocate;

a valve cartridge, configured for insertion into and removal from the bore as a unit, comprising a valve cartridge housing having an open end, and a plurality of valves operably connected to the valve cartridge housing; and a packing cartridge, configured for insertion into and removal from the bore as a unit, comprising a packing cartridge housing having a plunger bore, to receive the plunger, that defines a first open end and a second open end of the packing cartridge housing, wherein the valve cartridge housing and the packing cartridge housing are engaged such that the open end of the valve cartridge housing and the first open end of the packing cartridge housing overlap.

2. The fluid end of claim 1, wherein an interface between the valve cartridge housing and the packing cartridge housing is fluid tight.

3. The fluid end of claim 1, wherein an interface between the valve cartridge housing and the packing cartridge housing isolates a portion of the fluid end block, along the plunger bore, from cyclic pressure in the fluid end.

4. The fluid end of claim 1, wherein the first open end of the packing cartridge housing is at a neck of the packing cartridge housing, and wherein the neck is inserted into the valve cartridge housing.

5. The fluid end of claim 1, wherein the packing cartridge housing has an inner circumferential notch, and wherein the packing cartridge further comprises a packing disposed in the inner circumferential notch.

6. The fluid end of claim 5, wherein the packing cartridge further comprises a retainer clip to retain the packing in the inner circumferential notch.

7. The fluid end of claim 1, wherein the packing cartridge housing further comprises a tool engagement element to engage with a tool configured to insert and remove the packing cartridge from the bore.

8. The fluid end of claim 1, wherein the fluid end block has a front end and a back end opposite the front end, wherein the plunger is to extend into the bore from the back end, and wherein the fluid end block is configured to allow the packing cartridge to be removed from, or inserted into, the bore from the front end.

9. A fluid end of a fluid pump, comprising a fluid end block with a bore in which a plunger is to reciprocate;

a valve cartridge, configured for insertion into and removal from the bore as a unit, comprising:

a valve cartridge housing having an open end; and a plurality of valves operably connected to the valve cartridge housing; and a packing retaining component with a plunger bore, to receive the plunger, that defines a first open end and a second open end of the packing retaining component, wherein the valve cartridge housing and the packing retaining component are engaged such that the open end of the valve cartridge housing and the first open end of the packing retaining component overlap.

10. The fluid end of claim 9, wherein an interface between the valve cartridge housing and the packing retaining component is fluid tight.

11. The fluid end of claim 9, wherein an interface between the valve cartridge housing and the packing retaining component isolates a portion of the fluid end block, along the plunger bore, from cyclic pressure in the fluid end.

12. The fluid end of claim 9, wherein the packing retaining component is a packing cartridge configured for insertion into and removal from the bore as a unit.

13. The fluid end of claim 9, wherein the first open end of the packing retaining component is at a neck of the packing retaining component, and wherein the neck is inserted into the valve cartridge housing.

14. A fluid end of a fluid pump, comprising:

a fluid end block with a bore in which a plunger is to reciprocate;

a valve cartridge, configured for insertion into and removal from the bore as a unit, comprising a valve cartridge housing having an open end, and a plurality of valves operably connected to the valve cartridge housing; and a packing cartridge, configured for insertion into and removal from the bore as a unit, comprising a packing cartridge housing having a plunger bore, to receive the plunger, that defines a first open end and a second open end of the packing cartridge housing, wherein an interface between the valve cartridge housing and the packing cartridge housing is fluid tight to isolate a portion of the fluid end block, along the plunger bore, from cyclic pressure in the fluid end, wherein the valve cartridge housing and the packing cartridge housing are engaged such that the open end of the valve cartridge housing and the first open end of the packing cartridge housing overlap.

15. The fluid end of claim 14, wherein the first open end of the packing cartridge housing is at a neck of the packing cartridge housing, and wherein the neck is inserted into the valve cartridge housing.

16. The fluid end of claim 14, wherein the packing cartridge housing has an inner circumferential notch, and wherein the packing cartridge further comprises a packing disposed in the inner circumferential notch.

17. The fluid end of claim 16, wherein the packing cartridge further comprises a retainer clip to retain the packing in the inner circumferential notch.

18. The fluid end of claim 14, wherein the packing cartridge housing further comprises a tool engagement element to engage with a tool configured to insert and remove the packing cartridge from the bore.

19. The fluid end of claim 14, wherein the fluid end block has a front end and a back end opposite the front end, wherein the plunger is to extend into the bore from the back end, and wherein the fluid end block is configured to allow the packing cartridge to be removed from, or inserted into, the bore from the front end.

* * * * *